US007580034B2

(12) United States Patent
Lee et al.

(10) Patent No.: US 7,580,034 B2
(45) Date of Patent: Aug. 25, 2009

(54) APPARATUS FOR IMPROVING UNIFORMITY OF LUMINOSITY IN FLAT PANEL DISPLAY

(75) Inventors: Jung-Won Lee, Seoul (KR); Miyazawa Hiroshi, Suwon-si (KR); Suk-Beom You, Seoul (KR)

(73) Assignee: Samsung Mobile Display Co., Ltd., Yongin-si (KR)

( * ) Notice: Subject to any disclaimer, the term of this patent is extended or adjusted under 35 U.S.C. 154(b) by 684 days.

(21) Appl. No.: 10/916,552

(22) Filed: Aug. 12, 2004

(65) Prior Publication Data

US 2005/0035718 A1 Feb. 17, 2005

(30) Foreign Application Priority Data

Aug. 13, 2003 (KR) ..... 10-2003-0056270

(51) Int. Cl.
*G06F 3/038* (2006.01)

(52) U.S. Cl. ..... 345/211; 345/204; 315/167

(58) Field of Classification Search ..... 349/148–151; 345/211, 204; 315/164, 167, 168
See application file for complete search history.

(56) References Cited

U.S. PATENT DOCUMENTS 6,587,174 B1 * 7/2003 Nakano ..... 349/139
6,614,412 B1 * 9/2003 Hirano et al. ..... 345/60
6,683,669 B1 * 1/2004 Fujikawa ..... 349/149
6,909,409 B2 * 6/2005 Tanada ..... 345/51

* cited by examiner

*Primary Examiner*—Chanh Nguyen
*Assistant Examiner*—Pegeman Karimi
(74) *Attorney, Agent, or Firm*—H.C. Park & Associates, PLC

(57) ABSTRACT

A flat panel display includes a plurality of pixel anode electrodes arranged in a display area. A plurality of anode electrode lines for supplying a driving current to the pixel anode electrodes are connected at one end to pixel anode electrodes, and at the other to one or more current supply lines of a current supply line assembly. The current supply lines, in turn, are connected to first and second terminals to which the driving current is applied. The current supply line assembly also includes an impedance adjusting means for adjusting impedance of at least one of the first and second supply lines. The impedance adjusting means may be configured as a third separate supply line connected to at least one of the first and second supply lines, and the impedance of the current supply line is adjusted by varying the length or width of the third current supply line.

3 Claims, 9 Drawing Sheets

APPARATUS FOR IMPROVING UNIFORMITY OF LUMINOSITY IN FLAT PANEL DISPLAY

CROSS-REFERENCE TO RELATED APPLICATION

This application claims priority of Korean Patent Application No. 2003-56270, filed Aug. 13, 2003, which is herein incorporated by reference.

BACKGROUND OF THE INVENTION

The invention is directed to flat panel displays generally. More particularly, the invention is directed to an improved current supply line assembly having a uniform impedance, which is used in a flat panel display to improve the display's uniformity of luminance.

An active matrix organic light-emitting display (AMOLED) includes a plurality of electroluminescent (EL) elements. Each EL element has R, G and B organic emission layers interposed between an anode electrode and a cathode electrode. Each R, G and B emission layer emits light when a first voltage is applied to the anode electrode and a second different voltage is applied to the cathode electrode.

The anode electrodes are formed to be separated from one another in respective R, G and B unit pixels, but the cathode electrode is formed as a single planar electrode that covers a portion (or all) of the display area. A plurality of anode electrode lines supply current to the anode electrodes arranged in the R, G and B unit pixels. A current supply line assembly connected to a remote power source supplies current to the anode electrode lines.

FIG. 1 is a top view of a current supply line assembly used in a conventional active matrix organic light-emitting display. An insulating substrate 100 includes a display area 110 in which R, G and B unit pixels are arranged. A planar cathode electrode 120 is formed on a surface of the insulating substrate 100 to cover the display area 110. A supply line 121 connects the cathode electrode 120 to a drain terminal 150.

An anode wiring assembly 130 is used to supply a current to a plurality of anode electrodes located proximate the display area 110. The anode wiring assembly 130 includes a plurality of spaced apart anode electrode lines 131 connected to the anode electrodes in the display area 110, and a plurality of current supply lines to supply the current to each end of each anode electrode line 131. The current supply lines include first supply lines 132 and 133, and second supply lines 134 and 135 between the first supply lines 132 and 133 to connect the first supply lines 132 and 133. In one embodiment, supply line 132 includes ends 132*a* and 132*b*; and supply line 133 includes ends 133*a* and 133*b*. One end of each anode electrode line is connected to supply line 132. The other end of each anode electrode line is connected to supply line 133.

The current supply line assembly further includes first terminal 141 and a second terminal 142 to which a current from an external power source is supplied. One end of the third supply line 136 is connected to the first terminal 141, and the other end of the third supply line 136 is connected to the second supply line 134. Similarly, one end of the third supply line 137 is connected to the second terminal 142, and the other end of the third supply line 137 is connected to second supply line 135. One end of a A-fourth supply line 121 is connected to the terminal 150, and the other end of the fourth supply line 121 is connected to cathode electrode 120.

In use, current provided to the first and second terminals 141 and 142 flows to the anode electrode lines 131 via supply lines 136 and 137. In turn, the anode electrode lines 131 route the current to the display area 110. At display area 110, the current leaves the anode electrode lines 131 to flow through the anode electrode, the emission layer and the cathode electrode 120 of each pixel arranged in the display area 110. After leaving each pixel, the current flows via supply line 121 to the drain terminal 150.

A conventional current supply line assembly constructed as described above is configured so that an electrical resistance from a point P133 to a point P134. Such a configuration fails to maintain upper and lower symmetry and left and right symmetry or to minimize overall electrical resistance. For example, if first supply line 132 has a resistance R3, and first supply line 133 has a resistance R2, then the resistance R135 at point P135 is R135=R1+R3. Similarly, the resistance R137 at point P137 is R137=R2.

If the impedances of the supply lines that provide the current to both ends of the anode electrode line 131 are identical to each other, the resistances R135 and R137 at both ends P135 and P137 of the anode electrode line 131 are the same, resulting in R1+R3=R2. However, the impedances of the current supply lines, which provide the current via the terminal 141 to both ends of the anode electrode line 131, differ from each other. For example, the impedance of the supply line from the terminal 141 to the point P135 via the points P133 and P131 differs from the impedance of the supply line from the terminal 141 to the point P137 via the point P133 by an amount equal to the electrical resistance of supply line 134.

Likewise, the impedances of the supply lines through which current is provided to both ends of the anode electrode line 131 via the terminal 142 also differ from each other. That is, the impedance of the supply line from the terminal 142 to the point P136 via the points P134 and P132 differs from the impedance of the supply line from the terminal 142 to the point P138 via the point P134 by an amount equal to the electrical resistance of the supply line 135.

Thus, when anode wiring 130 is configured in the conventional manner, voltages of different values are applied to each end of each anode electrode line 131. For example, a different voltage is applied to the point P135 than is applied to the point P137. Similarly, a different voltage is applied to the point P136 than is applied to the point P138. Specifically, the voltages applied to the points P137 and P138 are larger than those applied to the points P135 and P136. In fact, the voltage applied to point P137 differs from the voltage applied to the point P135 by an amount equal to the electrical resistance of supply line 134. Similarly, the voltage applied to point P138 differs from the voltage applied to the point P136 by an amount equal to the electrical resistance of supply line 135.

FIG. 2 shows a chart illustrating current distribution in anode electrode lines of a conventional anode wiring assembly 130. FIG. 3 is a diagram that illustrates positions of current supply lines connected to the anode electrode lines that are referenced with respect to FIG. 2.

It is assumed that, in the anode wiring 130 of FIG. 1, a leftmost anode electrode line of the anode electrode lines 131 is L1, a center anode electrode line is L5. The anode electrode lines positioned between L1 and L5 are illustratively numbered L2, L3 and L4. It is also assumed that the position of the point P135 is X1, the position of the point P137 is X44, and the positions of points at a uniform distance between the position X1 and the position X44 are X2, X3, . . . , X43.

Under this assumption, referring to the current distribution chart shown in FIG. 2, the current value at the center anode electrode line L5 is relatively smaller than that of the outermost anode electrode line L1 due to a voltage drop resulting from the electrical resistances of the supply lines 132 and 133. Furthermore, in each of the anode electrode lines L1 to L5, a voltage applied to the position X44 is relatively higher than a voltage applied to the position X1. Consequently, the value of the current flowing around the position X44 becomes relatively larger than that flowing around the position X1. This increase in current flow is caused by the voltage drop resulting from the electrical resistances of the respective anode electrode lines L1 to L5. Consequently, it can be seen that the difference d1 between a minimum current value and a maximum current value of the anode electrode lines L1 to L5 at the position X1 is different from the difference d2 between a minimum current value and a maximum current value of the anode electrode lines L1 to L5 at the position X44. Specifically, d2 is larger than d1. Additionally, a position at which the current value in each of the anode electrode lines L1 to L5 is minimized is close to the point P135 rather than the point P137, such that the resistance value R1+R3 is larger than R2. The problem most associated with configuring an anode wiring 130 in the conventional manner is that anode electrode line assembly 131 has an asymmetrical current distribution, which creates a non-uniformity of luminance in the display area 110. Consequently, a solution is needed that provides uniformity of luminance over virtually all points of the display area 110.

SUMMARY OF THE INVENTION

The invention is directed to a flat panel display having an enhanced uniformity of luminance. In one embodiment, this is accomplished by incorporating in the flat panel display a supply line assembly configured to provide a uniform impedance.

In one embodiment the flat panel display includes a plurality of pixel anode electrodes arranged in a display area. A plurality of anode electrode lines for supplying a driving current to the pixel anode electrodes are connected at one end to pixel anode electrodes, and at the other to one or more current supply lines of a current supply line assembly. In turn, the current supply lines, are connected to first and second terminals to which the driving current is applied. The current supply line assembly also includes an impedance adjusting means for adjusting impedance of at least one of the first and second supply lines. The impedance adjusting means may be configured as a third separate supply line connected to at least one of the first and second supply lines, and the impedance of the current supply line is adjusted by varying the length or width of the third current supply line.

DETAILED DESCRIPTION OF THE INVENTION

Figure 1:
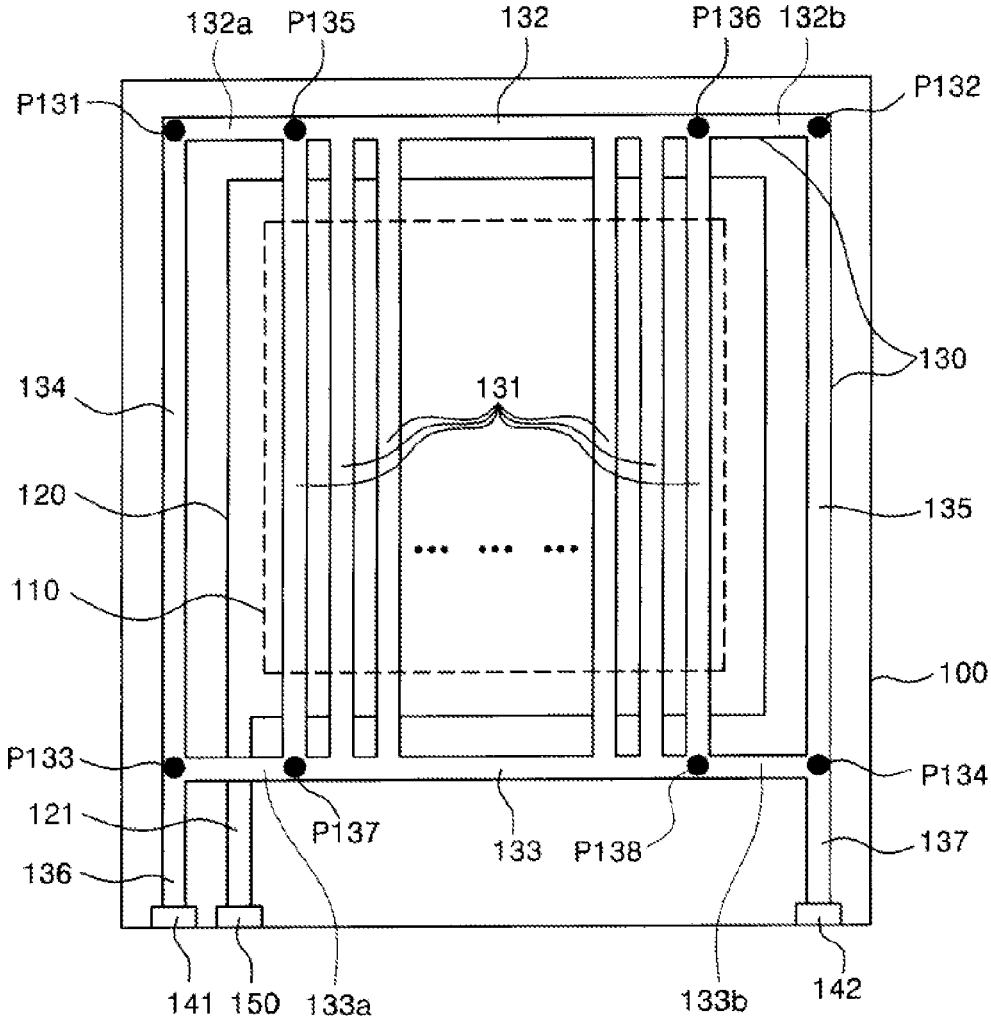
FIG. 1 (PRIOR ART)
FIG. 1 is a top view of a current supply line assembly used in a conventional flat panel display.

The invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout the specification.

Figure 4:
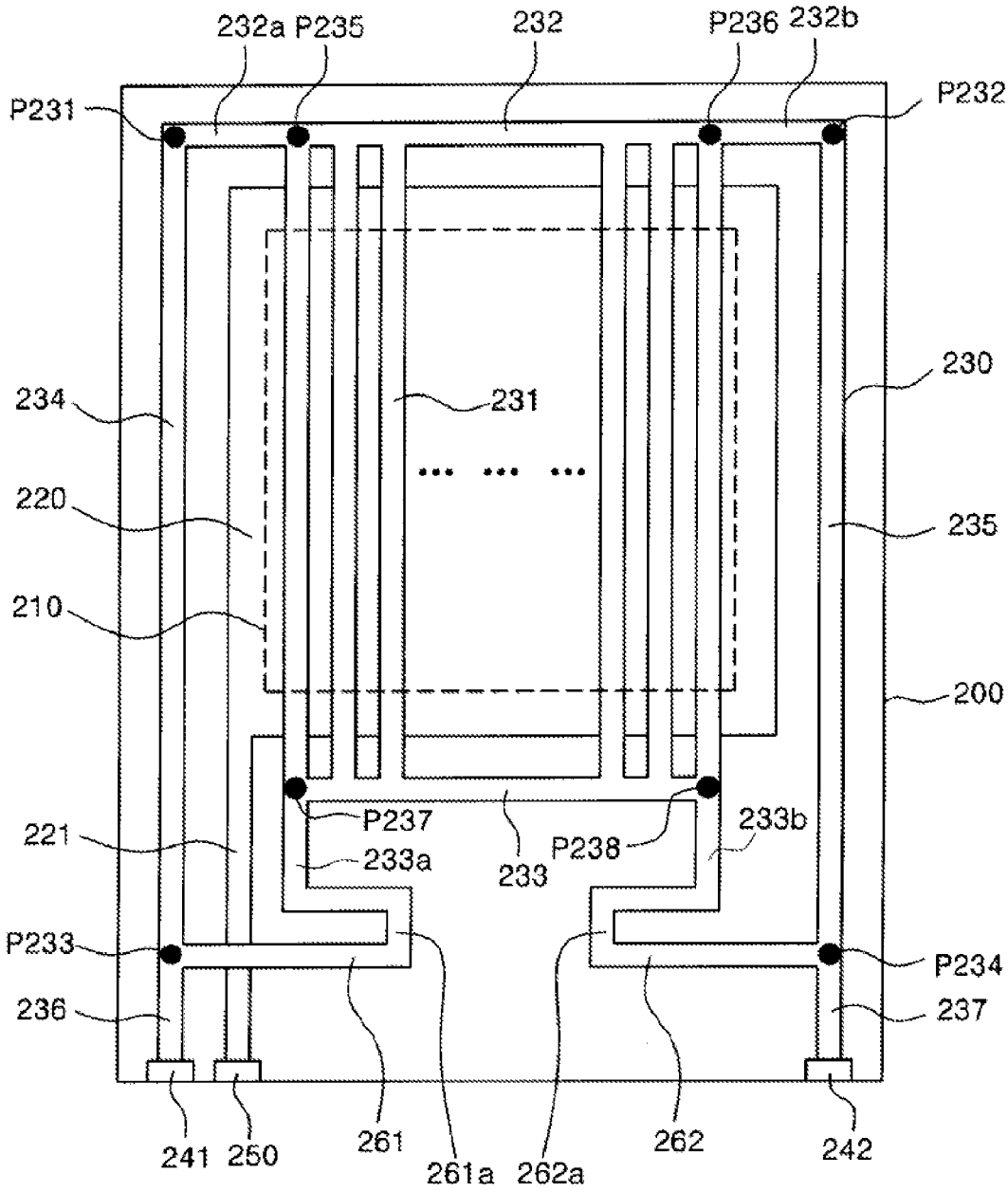
FIG. 4 is a top view of an anode wiring assembly configured according to one embodiment of the invention.

FIG. 4 is a top view of an anode wiring assembly 230 in an active matrix organic light-emitting display according to one embodiment of the invention. As shown, an insulating substrate 200 includes a display area 210 in which R, G and B unit pixels are arranged. A planar cathode electrode 220 is formed on the insulating substrate 200 and covers the display area 210. An anode wiring assembly 230 for supplying a current to the plurality of anode electrodes is located proximate the display area 210.

The anode wiring assembly 230 includes a plurality of anode electrode lines 231 corresponding to the display area 210 and arranged at a certain distance from one another to supply a current to anode electrodes in the display area 210, and a current supply line for supplying a current to both ends of each of the plurality of anode electrode lines 231.

The current supply line assembly includes first supply lines 232 and 233, and second supply lines 234 and 235. First supply line 232 includes ends 232*a*and 232*b*; and first supply line 233 includes ends 233*a* and 233*b*. Supply line 232 connects to one end of each of the plurality of anode electrode lines, and supply line 233 connects to the other end of each of the plurality of anode electrode lines. Additionally, second supply line 234 is connected at one end to end 232*a*, and is connected at the other end to end 233*a*. Similarly, second supply line 235 is connected at one end to end 232*b*, and is connected at the other end to end 233*b*.

The anode wiring assembly 230 includes first and second terminals 241 and 242 to which a current from the external source is supplied. Anode wiring assembly 230 also includes third supply lines 236 and 237. Supply line 236 connects at one end to first terminal 241, and connects at the other end to supply line 234. Supply line 237 connects at one end to second terminal 242, and connects at the other end to supply line 235. A fourth supply line 221 connects at one end with drain terminal 250, and connects at the other end to the cathode electrode 220. Terminals 241 and 242 are connected to an external power source to supply current from the external power source to one or more of the plurality of anode lines 231.

The anode wiring assembly 230 further includes a pair of sixth supply lines 261 and 262 as a means for maintaining the impedances at both ends of the anode electrode lines 231 approximately equal to the impedance at each of the terminals 241 and 242. That is, the supply line 261 creates an impedance between one end of the anode electrode line 231 and the terminal 241 (namely, an impedance between a point P235 and a point P233), and an impedance between the other end of the anode electrode lines 231 and the terminal 241 (namely, an impedance between a point P237 and the point P233) that are approximately equal to each other. In other words, supply line 261 is an illustrative means for maintaining a uniform impedance at each end of an anode electrode line. Further, the other supply line 262 creates an impedance between one end of the anode electrode lines 231 and the terminal 242 (namely, an impedance between a point P236 and a point P234), and an impedance between the other end of the anode electrode line 231 and the terminal 242 (namely, an impedance between an a point P238 and the point P234) that are approximately equal to each other. Thus, supply line 262 is an illustrative means for maintaining a uniform impedance at each end of an anode electrode line.

Supply lines 261 and 262 are called impedance adjusting supply lines, because the width, material(s) of which each is made, and/or length may be varied as needed to provide a uniform impedance.

In embodiments, current provided to the terminals 241 and 242 flows through the supply lines 236 and 237 to the anode electrode lines 231 from both sides, and in turn to the display area 210. That is, the current delivered through the supply line 236, flows on one side via supply line 234 and the end 232*a* of supply line 232 to an outermost (leftmost in the Figure) anode electrode line of the plurality of anode electrode lines 231. The current is also delivered via the supply line 232 to one end of each of the plurality of anode electrode lines 231. At the same time, the current flows to the other end of each of the plurality of anode electrode lines 231 via the impedance adjusting supply line 261 and the supply line 233.

Meanwhile, the current delivered via the supply line 237 flows on the other side via the supply line 235 and the end 232*b* of supply line 232 to the outermost (rightmost in the figure) anode electrode line of the plurality of anode electrode line 231. The current also flows through the supply line 232 to one end of each of the plurality of anode electrode lines 231. At the same time, the current flows to the other end of each of the plurality of anode electrode lines 231 via the impedance adjusting supply line 262 and the supply line 233. Thus, the impedance adjusting supply lines 261 and 262 balance the supply line assembly with a uniform impedance, and permit a current to flow to both ends of each of the anode electrode lines 231 over current paths that have substantially the same impedance.

The impedances of the current supply line at respective positions of the anode wiring assembly 230 of the invention are expressed by the following equations.

For example, let the resistance of the supply line 234 be R234, and let the resistance of the end 232*a* of supply line 232 be R232*a*. The resistance R261 of the impedance adjusting supply line 261 can then be expressed by equation 1:

$$R261=R234+R232a \tag{1}$$

Let the resistance of the supply line 235 be R235, and let the resistance of the end 232*b* of supply line 232 be R232*b*. The resistance R262 of the impedance adjusting supply line 262 can then be expressed by equation 2:

$$R262=R235+R232b \tag{2}$$

Accordingly, if the supply lines 234 and 235 have left and right symmetry (which they must if each has an impedance equal to the other), it can be seen from Equations 1 and 2 that the resistance values of the ends 232*a*and 232*b* of supply line 232 are identical to each other as expressed in Equation 3:

$$R234=R235,\ R232a=R232b \tag{3}$$

Meanwhile, if it is assumed that, the anode wiring assembly 230 includes the impedance adjusting supply lines 261 and 262 as illustratively shown, a minimum resistance ratio and a maximum resistance ratio of the resistance R234 to the resistance R261 may be computed at the point P237. Let min(R234, R261) represent the minimum resistance ratio of resistance R234 to resistance R261, and let max(R234, R261) represent a maximum resistance ratio. In the case of a conventional power supply line as shown in FIG. 1 that has no impedance adjusting supply lines, the resistance ratios at point P137 are: min(R1, R2) and max(R1, R2). From these mathematical representations, a relationship among (i) a resistance ratio at the point P237, (ii) a resistance ratio at the point P137, and (iii) a uniformity of the current distribution may be represented as noted below.

When the resistance ratio at the point P137 is max(R1, R2)/min(R1, R2), the resistance ratio at the point P237 is max(R234, R261)/min(R234, R261). When the resistance distribution in the power supply line is uniform, the resistance ratio, max(R1, R2)/min(R1, R2)=1. In this scenario, the resistance R234 has the same value as the resistance R1 (e.g., R234=R1).

When the uniformity of the current distribution corresponding to the resistance ratio max(R1, R2)/min(R1, R2) in the conventional case is U0, the uniformity of the current distribution corresponding to the resistance ratio max(R234, R261)/min(R234, R261) is Ux. With this in mind, the uniformity of the current distribution when the impedances of current supply lines that deliver current to both ends of the anode electrode line are the same is U1. Thereafter, U0/U1, U1/U1 and Ux/U1 are obtained through normalization by U1 in each case. At this time, the uniformity of the current distribution, UNI, is expressed by Equation 4, in which the symbol I represents current.

$$U=(I\max-I\min)/I\max \tag{4}$$

In equation 4, Imax represents the maximum current flowing through the anode electrode line, and Imin represents the minimum current flowing though the anode electrode line.

Accordingly, in the case where the anode wiring includes the impedance adjusting supply lines of the invention, the relationship between the uniformity of the current distribution and the resistance ratio max(R234, R261)/min(R234, R261) can be expressed as Equation 5.

$$\left[\frac{\max(R1,\ R2)}{\min(R1,\ R2)}-1\right]:\left[\frac{U0}{U1}-1\right]=\left[\frac{\max(R234,\ R261)}{\min(R234,\ R261)}-1\right]:\left[\frac{Ux}{U1}-1\right] \tag{5}$$

From Equation 5, the resistance ratio, max(R234, R261)/min(R234, R261), is expressed by equation 6.

$$\frac{\max(R234,\ R261)}{\min(R234,\ R261)}\le\frac{Ux-U1}{U0-U1}\times\left[\frac{\max(R1,\ R2)}{\min(R1,\ R2)}-1\right]+1 \tag{6}$$

In one embodiment, the resistance value R261 of the impedance adjusting current supply line 261 is set in a range in which the resistance ratio, max(R234, R261)/min(R234, R261), satisfies the uniformity of the current distribution expressed by Equation 6. That is, if the impedances of the current supply lines that supply the current to both ends of each anode electrode line are adjusted by the impedance adjusting supply lines 261 and 262 until they are equal, then the uniformity of the current distribution Ux approximates the uniformity of the current distribution U0, this results in max(R234, R261)/min(R234, R261)=1 and accordingly max (R234, R261)=min(R234, R261). Consequently, a current is supplied to both ends of the anode electrode line assembly 231 via current supply paths having the same impedance. If the current supply lines have the same impedance, then the anode wiring assembly has upper and lower symmetry as well as left and right symmetry.

Figure 5:
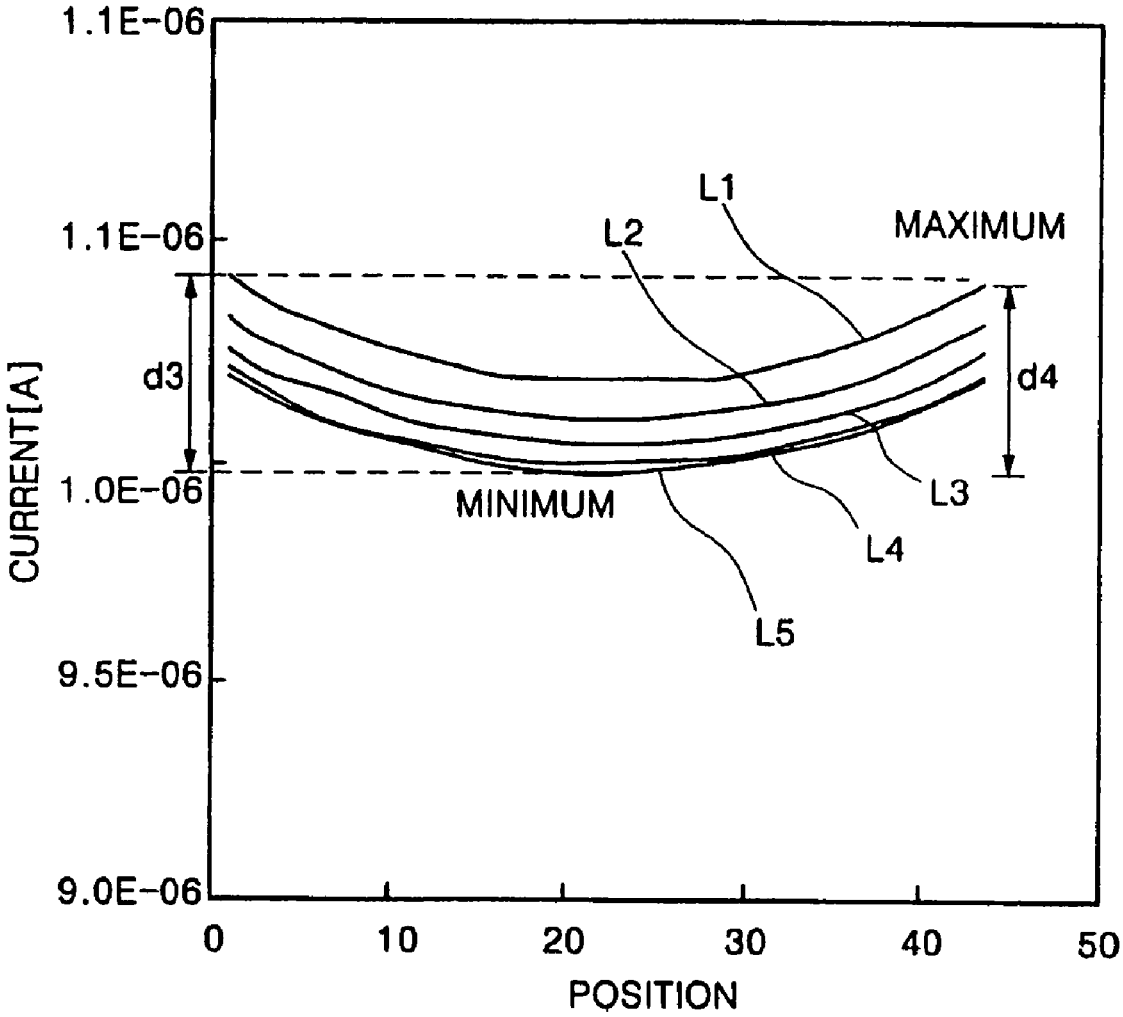
FIG. 5 is a chart illustrating current distribution in a current supply line assembly configured according to one embodiment of the invention.

FIG. 5 is a chart illustrating current distribution in the anode electrode lines 231 of the anode wiring assembly 230 according to one embodiment of the invention. Referring to FIG. 5, a difference d3 between a minimum current value and a maximum current value of the anode electrode lines L1 to L5 at a position X1 and a difference d4 between a minimum current value and a maximum current value of the anode electrode lines L1 to L5 at a position X44 are substantially similar to each other and preferably are identical. Furthermore, inflection points of the current distribution curve, which are points at which the current values of the respective anode electrode lines L1 to L5 become minimized, are present between the position P1/4 and the position P3/4 of the respective anode electrode lines L1, L2, L3, L4 and L5, and are preferably approximate to the position P1/2.

Accordingly, it can be seen that the current distributions at the positions X1 and X44 of the respective anode electrode lines L1 to L5 arranged in the display area 210 are symmetric. That is, when the same voltages from the external source are applied to the terminals 241 and 242 of the anode wiring assembly 230, the voltages at the points P235, P237, P236 and P238 become the same, the current will have upper and lower symmetry and left and right symmetry, as shown in FIG. 5.

Figure 2:
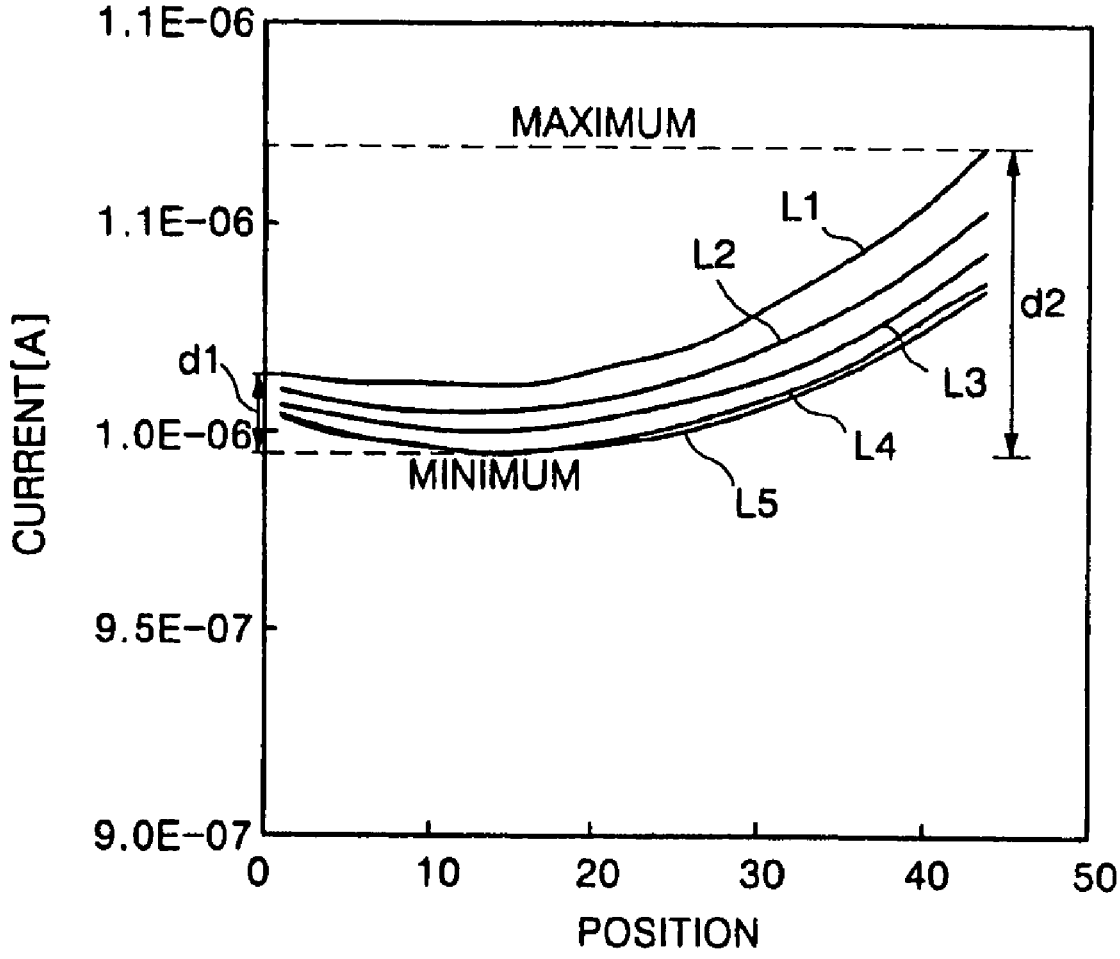
FIG. 2 (PRIOR ART)
FIG. 2 shows a chart illustrating current distribution in a current supply line assembly of a conventional flat panel display.
Figure 3:
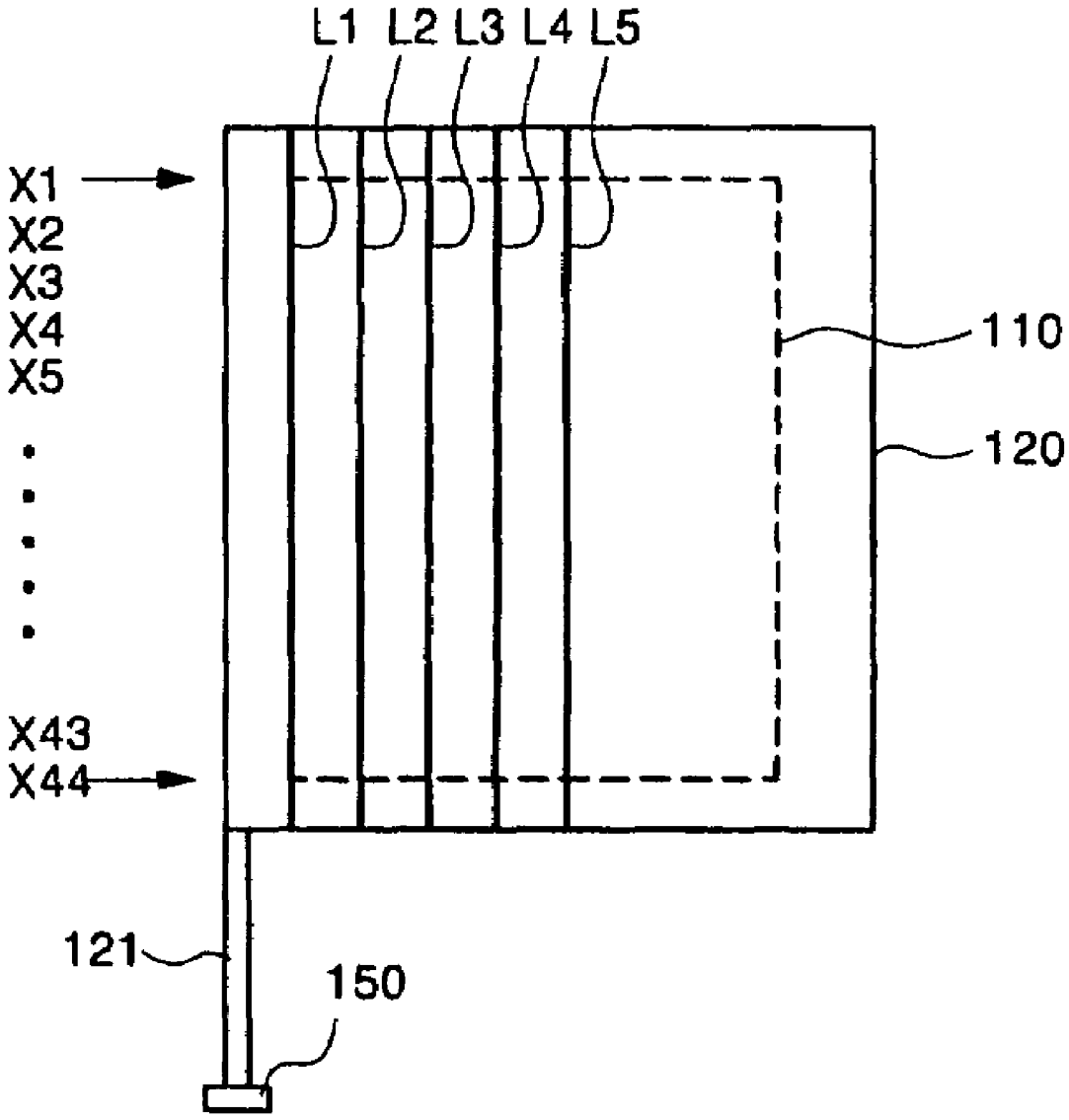
FIG. 3 (PRIOR ART)
FIG. 3 is a diagram showing a relationship between the length and the position of a current supply line assembly used in a conventional flat panel display.

It can be seen, from comparison of the current distribution of the conventional current supply line of FIG. 2 to the current distribution of the current supply line of the invention of FIG. 5, that the difference between the maximum current value and the minimum current value in the invention is reduced as compared to the conventional case because the current flowing through the current supply line has upper and lower symmetry as well as left and right symmetry.

Further, calculating the current uniformity using Equation 4, the conventional anode wiring assembly 130 has a uniformity of 7.0% while the improved anode wiring assembly 230 of the invention has a uniformity of 4.2%. From this, it can be seen that uniformity of current distribution (and also luminosity) has been enhanced as compared to the conventional structure of a current supply line assembly. Because luminance is proportional to current flow, improved uniformity of current distribution enhances uniformity of luminance.

In the above-described embodiment of the invention, the impedance adjusting supply line 261 is illustrated as connecting between the point P237 and the point P233. But the invention is not so limited. For example, where supply line 133*a* is connected to the point P233 as in FIG. 1, the impedance adjusting supply line 261 may connect between the supply line 133*a* and the point P237. Likewise, where the supply line 133*b* is connected to the point P234 as in FIG. 1, the impedance adjusting supply line 262 may connect between the supply line 133*b* and the point P237.

In such a case, the resistance value of the impedance adjusting supply line is adjusted so that the sum of the resistance of the supply line 133*a* and the resistance of the impedance adjusting supply line 261, or the sum of the resistance of the supply line 133*a* and the resistance of the impedance adjusting supply line 262, satisfies Equation 6.

Figure 6:
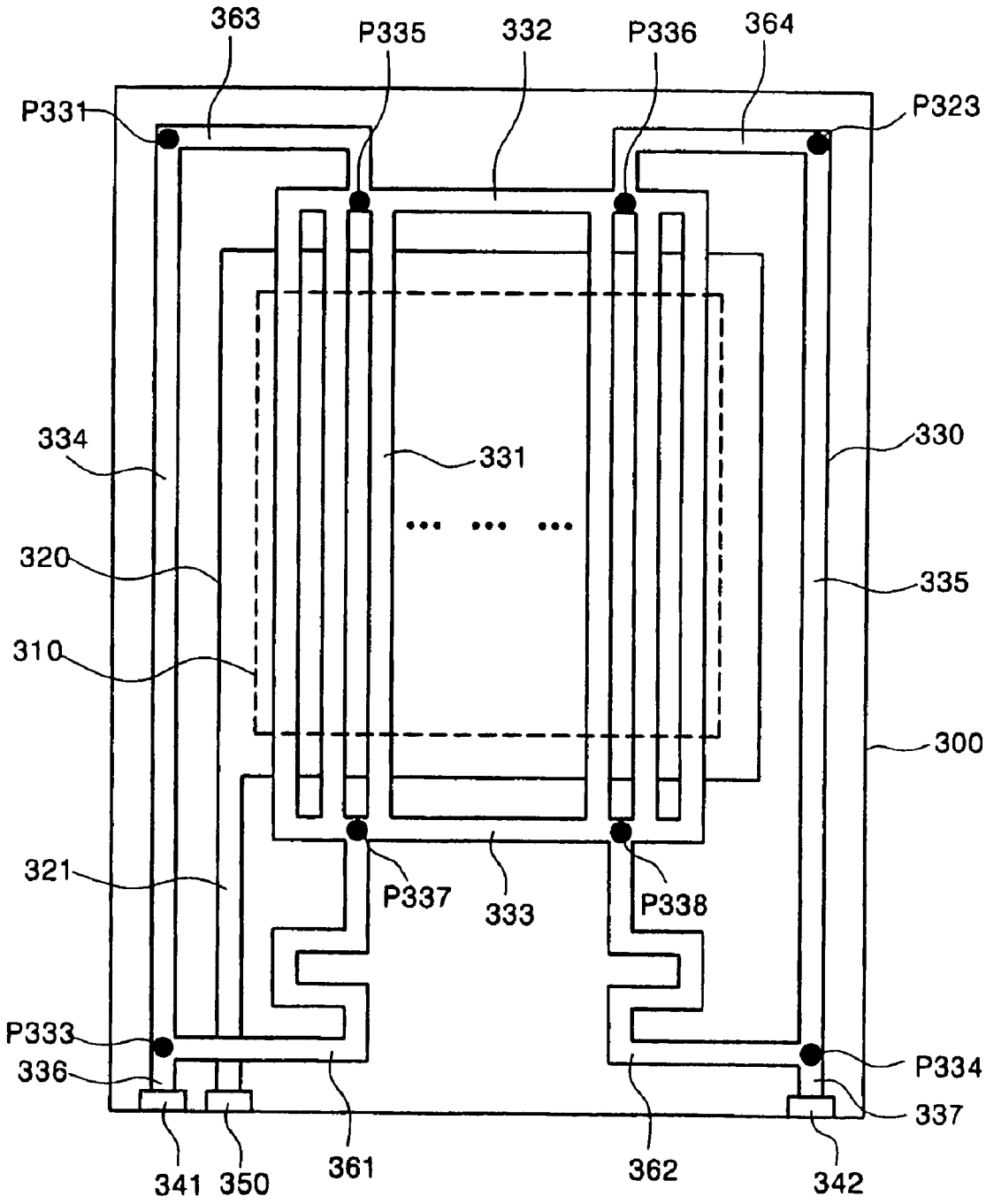
FIG. 6 is a top view of a current supply line assembly configured according to a second embodiment of the invention.

FIG. 6 is a top view of an anode wiring assembly 330 used in an OLED, and configured according to another embodiment of the invention. As shown, the anode wiring assembly 230 is substantially similar to that of the first embodiment. For example, the wiring assembly 330 of this embodiment is configured so that the current delivered through supply lines 336 and 337 from terminals 341 and 342 flows to an arbitrary anode electrode line of the plurality of anode electrode lines 331 arranged in a display area 310.

The anode wiring assembly 330 further includes a pair of first supply lines 361 and 362 and a pair of second supply lines 363 and 364 for impedance adjustment. Thus, the current supply line 330 is configured so that: (i) the impedance from the terminal 341 to the point P335 via the supply lines 336, 334 and 363 is the same as the impedance from the terminal 341 to the point P337 via the supply lines 336 and 361; and (ii) the impedance from the terminal 342 to the point P336 via the supply lines 337, 335 and 364 is the same as the impedance from the terminal 342 to the point P338 via the supply lines 337 and 362.

Accordingly, the current flows through supply lines 336, 334 and 363 to an arbitrary anode electrode line, which is not the outermost or center anode electrode line among the plurality of anode electrode lines 331. Additionally, the current flows through the supply line 332 to one end of each of the plurality of anode electrode lines 331. Simultaneously, current flows through supply line 361 to an arbitrary anode electrode line which is not the outermost or center supply line. Additionally, the current flows through the supply line 333 to the other end of each of the plurality of anode electrode lines 331.

Meanwhile, current also flows through supply lines 337, 335 and 364 to an arbitrary anode electrode line which is not the outermost or center anode electrode line among the plurality of anode electrode lines 331. Additionally, the delivered current flows through supply line 332 to one end of each of the plurality of anode electrode lines 331. Simultaneously, current flows through the supply line 362 to an arbitrary anode electrode line which is not the outermost and center anode electrode line among the plurality of anode electrode lines, Additionally, current flows through the supply line 333 to the other end of each of the plurality of anode electrode lines 331.

The impedances of the supply lines at respective positions in the anode wiring assembly 330 of the invention are expressed by the following equations.

For example, if it is assumed that (i) the resistance of the supply line 334 is R334, (ii) the resistance of the supply line 363 is R363, (iii) the resistance of the supply line 335 is R335, and (iv) the resistance of the supply line 364 is R364, then the resistances R261 and R262 of the impedance adjusting supply lines 361 and 362 are expressed by equations 7 and 8, respectively. Equation 9 can be obtained from the equations 7 and 8, because the impedance of the anode wiring assembly has left and right symmetry.

$$R361=R334+R363 \tag{7}$$

$$R362=R335+R364 \tag{8}$$

$$R334=R335, R363=R364 \tag{9}$$

Even in this illustrative embodiment, the resistance values R361, R362, R363 and R364 of the pairs of the impedance adjusting current supply lines 361 and 362, and 363 and 364 are set to satisfy Equation 6. Thus, since the current is provided to the internal anode electrode lines except for the outermost and center anode electrode lines among the plurality of anode electrode lines 331, the difference between the maximum current value and the minimum current value can be further reduced. This in turn improves the uniformity of both current distribution and luminance.

Figure 7:
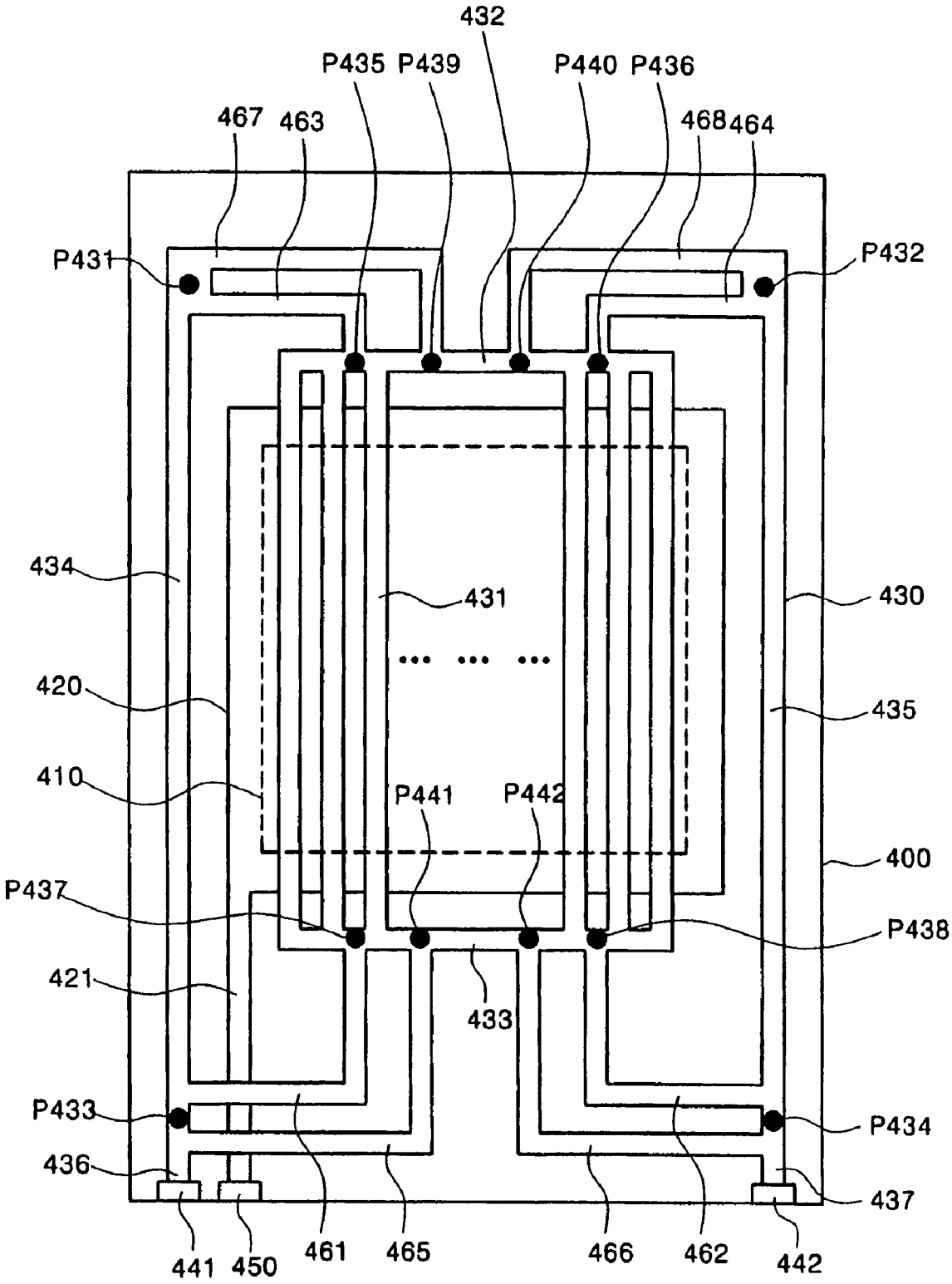
FIG. 7 is a top view of a current supply line assembly configured according to a third embodiment of the invention.

FIG. 7 is a top view of an anode wiring in an OLED configured according to another embodiment of the invention. As shown, the anode wiring assembly 430 of this embodiment is similar to the embodiment described with reference to FIG. 6. There is a difference only in that a means for adjusting the impedance of a supply line for supplying a current from terminals 441 and 442 to ends of a plurality of anode electrode lines 431 is composed of a plurality of supply lines 463, 467, 464 and 468. Another difference is that a means for adjusting the impedance of a supply line for supplying the current from the terminals 441 and 442 to the others of the plurality of anode electrode lines 431 arranged in the display area 410 is composed of a plurality of supply lines 461, 465, 462 and 466.

The anode wiring assembly 430 according to this embodiment further includes a plurality of first supply lines 461, 462, 465 and 466. Also included are a plurality of second supply lines 463, 464, 467 and 468 for impedance adjustment. For example, the anode wiring assembly 430 is configured so that the impedance from the terminal 441 via the supply lines 436, 434 and 463 to the point P435 is the same as that from the terminal 441 via the supply lines 436 and 461 to the point P437. It is also configured so that the impedance of the terminal 441 via the supply lines 436, 434 and 467 to the point P439 is the same as that from the terminal 441 via the supply lines 436 and 465 to the point P441.

Further, the anode wiring assembly 430 is configured so that the impedance from the terminal 442 to the point P436 via the supply lines 437, 435 and 464 is the same as that from the terminal 442 to the point P438 via the supply lines 437 and 462. Additionally, the anode wiring assembly 430 is configured so that the impedance from the terminal 442 to the point P440 via the supply lines 437, 435 and 468 is the same as that from the terminal 442 to the point P442 via the supply lines 437 and 466.

Even in this embodiment however, the resistance values R461, R462, R463, R464, R465, R466, R467 and R468 of the pairs of the impedance adjusting current supply lines 463 and 467; 464 and 468; 461 and 465; and 462 and 466 are chosen satisfy Equation 6.

Consequently, the current flowing through the supply lines 436 is delivered to arbitrary anode electrode lines, that are not the outermost (leftmost in the Figure) or center anode electrode line among the plurality of anode electrode lines 431, via the supply lines 434 and 463 or via the supply lines 434 and 467. Additionally, current flows to ends of the plurality of anode electrode lines 431 via the supply line 432. Simultaneously, current flows to arbitrary anode electrode lines, that are not the outermost or center anode electrode line among the plurality of anode electrode lines 431, via the supply line 461 or 465. Additionally, current flows to the other end of each of the plurality of anode electrode lines 431 via the supply line 433.

Meanwhile, the current delivered through the supply line 437 flows to an arbitrary anode electrode line that is not the outermost or center anode electrode line among the plurality of anode electrode lines 431, via the supply lines 435 and 464 or the supply lines 435 and 468. Additionally, current flows through the supply line 432 to one end of each of the plurality of anode electrode lines 431 arranged in the display area 410. Simultaneously, current flows through the supply line 462 or supply line 466 to an arbitrary anode electrode line, that is not the outermost and center anode electrode line among the plurality of anode electrode lines 431. Additionally, current flows through the supply line 433 to the other ends of each of the plurality of anode electrode lines 431.

The impedances of the current supply line at respective positions of the anode wiring assembly 430 of the invention are expressed by the following equations.

For example, let the resistances of the supply lines 434, 463 and 467 be R434, R463 and R467, respectively; and let the resistances of the supply lines 435, 464 and 468 be R435, R464 and R468, respectively. Then the resistances R461, R462, R465 and R466 of the impedance adjusting supply lines 461, 462, 465 and 466 are expressed by equations 10, 11, 12 and 13. Further, since the impedance of the anode wiring assembly 430 has left and right symmetry, Equations 14, 15 and 16 can be obtained from Equations 10 to 13.

$$R461=R434+R463 \quad (10)$$

$$R465=R434+R467 \quad (11)$$

$$R462=R435+R464 \quad (12)$$

$$R466=R435+R468 \quad (13)$$

$$R434=R435 \quad (14)$$

$$R461=R462=R465=R466 \quad (15)$$

$$R463=R464=R467=R468 \quad (16)$$

Figure 8:
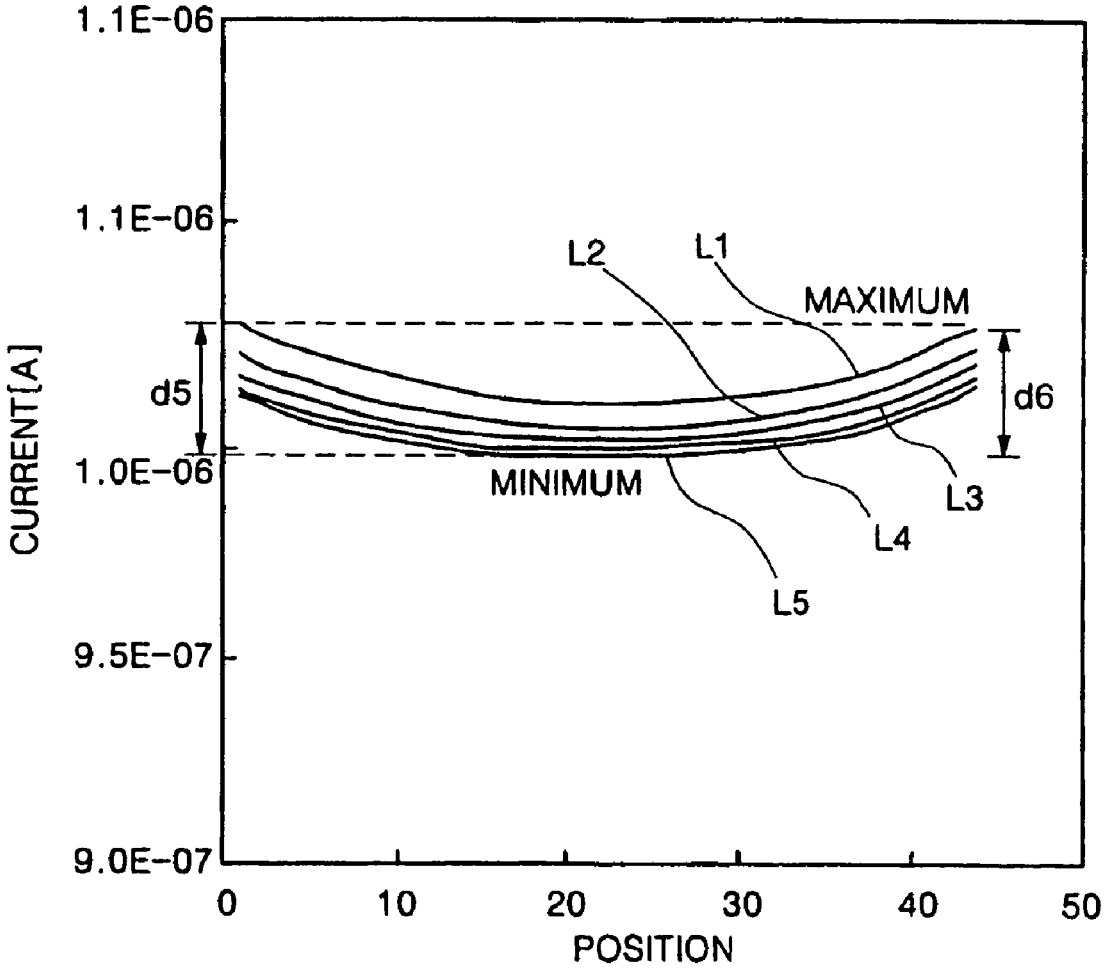
FIG. 8 is a chart illustrating current distribution in a current supply line assembly configured according to a third embodiment of the invention.

FIG. 8 is a chart illustrating current distribution in anode electrode lines of the anode wiring assembly 430 according to a third embodiment of the invention. Referring to FIG.8, a difference d5 between minimum and maximum current values of the anode electrode lines L1 to L5 at the position X1 and a difference d6 between minimum and maximum current values of the anode electrode lines L1 to L5 at the position X44 are substantially similar and preferably identical to each other. Further, an inflection point of the current distribution curve, which is a point where a current value of each of the anode electrode lines L1 to L5 is minimized, is present between a position P1/4 and a position P3/4 of each of the anode electrode lines L1 to L5, and is preferably close to the position P1/2.

In addition, referring to FIG. 8, it is seen that a difference between the difference d5 between the minimum and maximum current values of the anode electrode lines L1 to L5 and the difference d6 between the minimum and maximum current values of the anode electrode lines L1 to L5 is further reduced as compared to the first and second embodiments. This confirms that uniformity of current distribution and uniformity of luminance varies depending on the placement and configuration of the impedance adjusting supply lines.

Accordingly, in the third embodiment, if the same voltages are applied to the terminals 441 and 442, respective voltages at the points P435, P439, P440 and P436 and the points P437, P441, P442 and P438 become the same, such that the current distribution at the positions X1 and X44 of the respective anode electrode lines L1 to L5 arranged in the display area 410 has upper and lower symmetry and left and right symmetry. The symmetric inductance permits uniformity of current distribution uniformity and luminance to be further improved.

In the embodiments discussed above, the impedance is adjusted by adding impedance adjusting supply lines to a current supply line assembly disposed in a flat display panel in which pixels are arranged to adjust the electrical resistance. In other embodiments, the impedance may be adjusted by adjusting the width of the current supply line or by using a material of a different electrical resistance for the current supply line. Thus, the length, width, and material forming an impedance adjusting supply line may be varied as needed to achieve uniform impedance and improved uniformity of luminosity.

Figure 9:
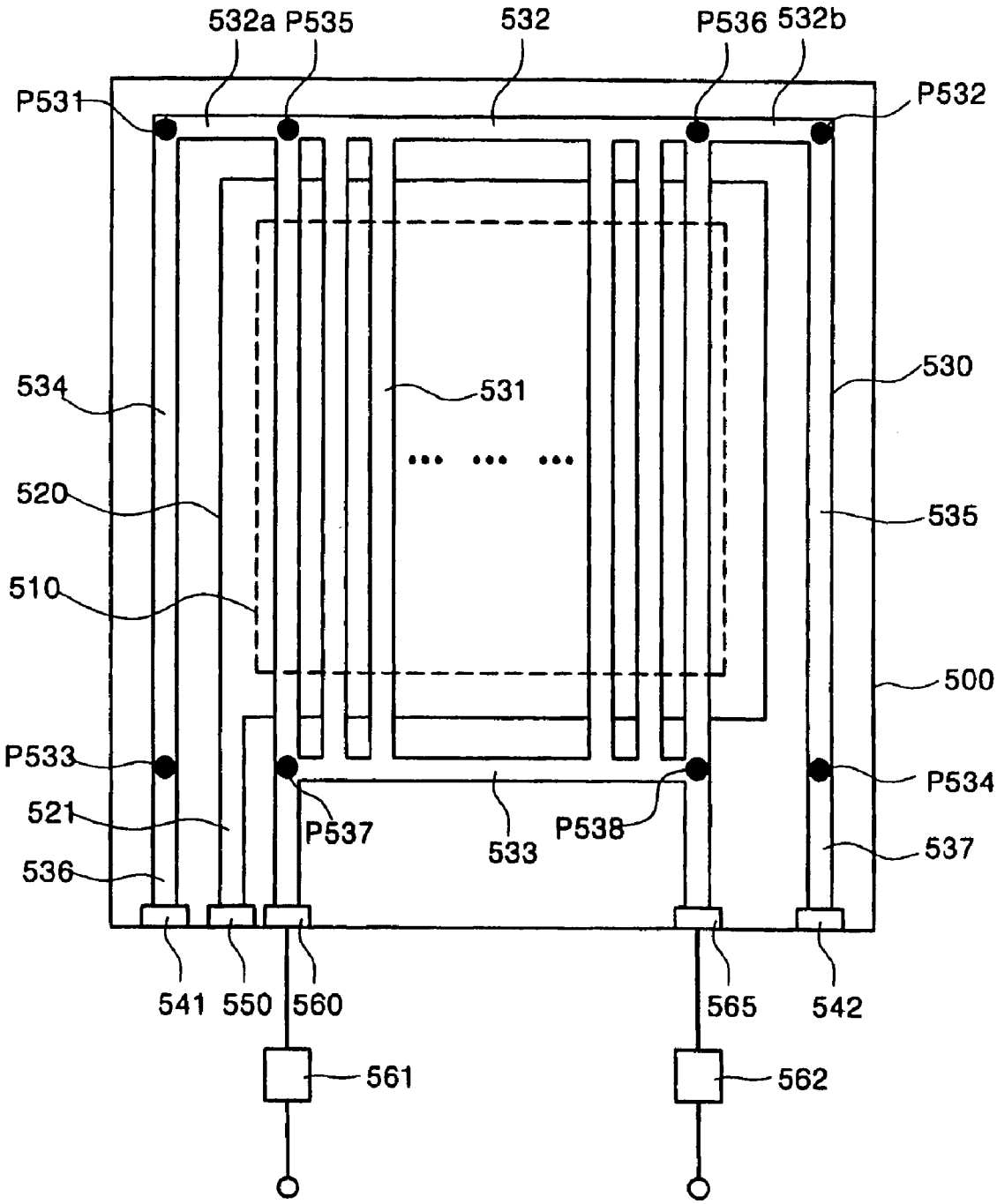
FIG. 9 is a top view of a current supply line assembly configured according to a fourth embodiment of the invention.

FIG. 9 is a top view of a current supply line assembly according to a fourth embodiment of the invention. The placement and configuration of the power supply line assembly of this embodiment is the same as the first embodiment except that the amount of the current provided to first and second terminals 541 and 542 is controlled by connecting impedance adjusting resistors 561 and 562 outside the flat display panel. This method of varying current is an alternative to the method and apparatus first described in which separate current supply lines for impedance adjustment were arranged in an AMOLED.

Although the invention has been described with reference to the preferred embodiments of the invention, it will be appreciated by those skilled in the art that a variety of modifications and variations can be made to the invention departing from the spirit and scope of the invention defined in the appended claims.

What is claimed is:

1. A flat panel display comprising:

a plurality of pixel anode electrodes arranged in a display area;

a plurality of anode electrode lines for supplying a driving current to the pixel anode electrodes;

first and second terminals to which the driving current is applied;

a current supply line assembly including a plurality of first supply lines for providing the driving current from the first terminal to one side of each of the anode electrode lines, and a plurality of second supply lines for providing the driving current from the second terminal to the other side of each of the anode electrode lines; and an impedance adjusting means for adjusting impedance of at least one of the first and second supply lines, wherein each of the first and second supply lines is provided with a first line having one side connected to the terminal, a second line connected between the other side of the first line and the other side of an anode electrode line, a third line having one side connected to one side of the anode electrode, and a fourth line connected between the other side of the first line and the other side of the second line; and the impedance adjusting means is connected between the other side of the second line and the other side of the anode electrode line and has a resistance value set to satisfy the following equation, $$\frac{\max(R1, R3)}{\min(R1, R3)} \leq \frac{Ux - U1}{U0 - U1} \times \left[\frac{\max(R1, R2)}{\min(R1, R2)} - 1\right] + 1$$

where, the resistance of the fourth line is R1, the resistance of the second line when the impedance adjusting means is not connected is R2, sum of the resistances of the second line and the impedance adjusting means is R3, a minimum resistance ratio of the resistance R1 to the resistance R2 is min(R1, R2) and a maximum resistance ratio thereof is max(R1, R2), a minimum resistance ratio of the resistance R1 to the resistance R3 is min(R1, R3) and a maximum resistance ratio thereof is max(R1, R3), a current distribution of each anode electrode line when the impedance adjusting means is not connected is U0, a current distribution of each anode electrode line when a resistance distribution of the power supply line is uniform is U1, and a current distribution of each anode electrode line when the impedance adjusting means is connected is Ux.

2. The flat panel display according to claim 1, wherein the impedance adjusting means is configured as a third separate supply line connected to at least one of the first and second supply lines and adjusts the impedance of the current supply line by varying at least one of a length and a width of the third current supply line.

3. The flat panel display according to claim 1, wherein the impedance adjusting means is arranged outside the flat panel display and is composed of a resistance connected to at least one of the first terminal and the second terminal.

* * * * *

UNITED STATES PATENT AND TRADEMARK OFFICE

CERTIFICATE OF CORRECTION

PATENT NO. : 7,580,034 B2
APPLICATION NO. : 10/916552
DATED : August 25, 2009
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1353 days.

Signed and Sealed this

Fourteenth Day of September, 2010

David J. Kappos

David J. Kappos
*Director of the United States Patent and Trademark Office*